United States Patent [19]

Berg

[11] 4,084,457

[45] Apr. 18, 1978

[54] SCREW REMOVING TOOL

[76] Inventor: Donald L. Berg, 114 N. Douglas St., Dodgeville, Wis. 53533

[21] Appl. No.: 810,936

[22] Filed: Jun. 29, 1977

[51] Int. Cl.[2] ..... B25B 7/02

[52] U.S. Cl. ..... 81/425 R; 254/22

[58] Field of Search ..... 81/418, 425 R, 425 A, 81/5.1; 254/22

[56] References Cited

U.S. PATENT DOCUMENTS

| | | | |
|---|---|---|---|
| 181,201 | 8/1876 | Platt | 81/421 |
| 1,020,361 | 3/1912 | Moore | 81/425 R |
| 1,813,038 | 7/1931 | Erne | 81/418 |
| 2,043,373 | 6/1936 | Gairoard | 254/22 |
| 2,629,114 | 2/1953 | Peterson | 254/22 |
| 2,645,960 | 7/1953 | Pray | 81/425 R |

*Primary Examiner*—James L. Jones, Jr.

*Attorney, Agent, or Firm*—Theodore J. Long; Harry C. Engstrom; Nicholas J. Seay

[57] ABSTRACT

A tool for removing embedded screws and the like, having a pair of pivotally connected handles with screw removing heads at the ends thereof. The screw removing heads each have matching opposed clinching edges, including a pair of laterally spaced parallel clinching edges and a clinching edge at the bottom of each head which is perpendicular to the parallel edges and disposed between them. The parallel edges dig into the periphery of the screw head to allow torque to be applied to the screw as the handles are turned by a user, while the perpendicular clinching edges engage the underside of the head of an embedded screw to oppose slipping movement of the tool off the screw head and apply upward force thereto.

10 Claims, 6 Drawing Figures

SCREW REMOVING TOOL

BACKGROUND OF THE INVENTION

1. Field of the Invention

This invention pertains generally to hand tools and more particularly to such tools used for removing screws, nails and the like.

2. Description of the Prior Art

Quite commonly, screws that have been turned tightly into place will have the screwdriver slots therein stripped off so that it is difficult or impossible to remove the screws with a screwdriver. This situation is particularly common with Phillips head screws.

Such embedded stripped screws can sometimes be removed by nail removing devices such as a claw hammer, or the screw head can be clipped or chiseled off. However, it is often desired to completely remove the screw without further damaging the screw hole. In such situations, the screw must be turned out by some means. Ordinary pliers can sometimes be used to grasp the head of the screw to turn it, but usually this method of removal is very difficult if the screw is firmly embedded, with the usual result that the ordinary pliers will slip off the screw head when force is applied.

SUMMARY OF THE INVENTION

A screw removing tool in accordance with my invention is constructed wherein screw removing heads are mounted upon or formed integrally with the ends of connected handles for forcing the screw removing heads toward each other. In my preferred embodiments, I employ handles of the common pliers type, pivotally connected, with the screw removing heads located in the jaw position. With the use of my tool it is possible to easily remove screws that are completely stripped of a screwdriver slot, and which are firmly embedded in very hard material such as sheet metal. A user very simply utilizes the tool by applying pressure to the handles to grasp the screw with the screw removing heads, whereby turning the handes while applying pressure to them forces the screw to be turned out with the aid of its own screw thread.

Each of the opposed heads of my screw removing tool has a pair of parallel clinching edges which are disposed in laterally spaced relation, and a third clinching edge which is disposed between and perpendicular to the other two edges at the innermost bottom edge of the head. The three clinching edges thus define a general "U" shaped clinching line, with the spacing between the parallel clinching edges being less than the diameter of the head of the screw to be removed.

When a screw head is engaged between the two screw removing heads, and pressure is applied by the user to the handles, the parallel clinching edges will dig into the periphery of the screw head, while the third perpendicular clinching edge will tend to slip under the head of the screw to engage the underside of the head. With the perpendicular edges beneath the screw head, or at least digging into the side of the screw head, vertical force can be exerted on the screw by pulling on the handles and the perpendicular clinching edges will resist slippage of the tool off the head. Moreover, the parallel edges dig into the side of the screw head to allow torque to be applied to the screw as the handles of the tool are turned. This allows the user to merely rotate the tool handle while gripping the same to turn the screw out of its hole without damaging any threads within the hole.

My screw removing tool can be formed to have the U-shaped cutting edge jaws in position to grasp a screw head much as an ordinary pliers, that is, with the bottom of the U-shaped jaw at the end of the screw removing heads. Alternatively, the tool may be formed with the jaws placed sideways, with the bottom of the U-shaped jaws at one side of the heads rather than at the bottom. In this configuration, a user would grasp the screw head from the side, and would turn the screw out by rotating the entire screw removing tool around the screw head.

Further objects, features, and advantages of my invention will be apparent from the following detailed description taken in conjunction with the accompanying drawings showing preferred embodiments of a screw removing tool exemplifying the principles of my invention.

DESCRIPTION OF THE PREFERRED EMBODIMENTS

Figure 1:
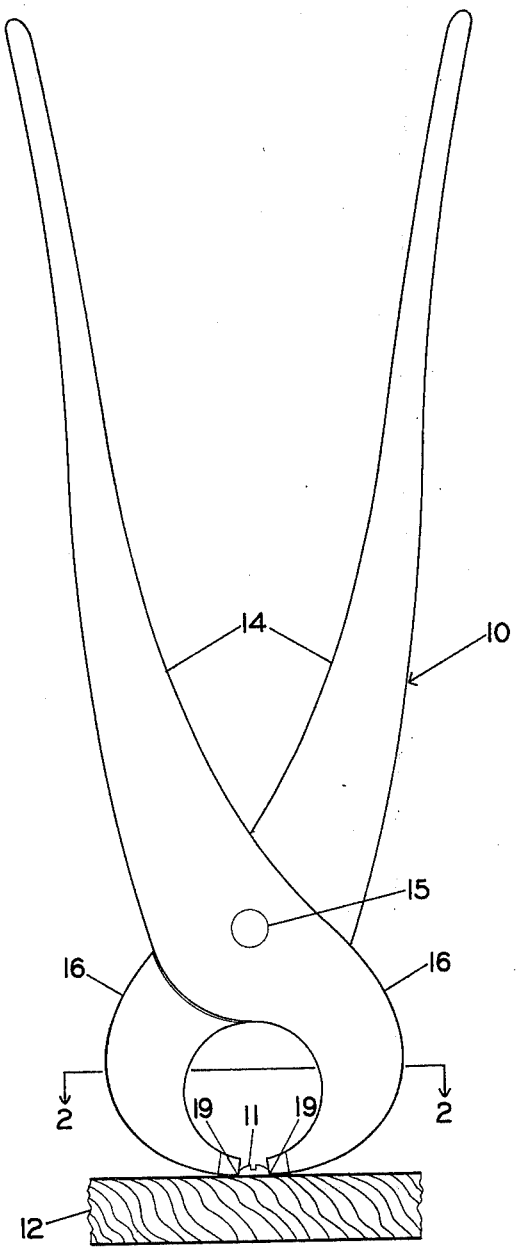
FIG. 1 is a side elevational view of one embodiment of my screw removing tool shown in position to engage the head of a screw.

Referring now more particularly to the drawings, wherein like numerals refer to like parts throughout the several views, a preferred embodiment of my screw removing tool is shown generally at 10 in position to remove a screw 11 which has been embedded in a surface 12.

The screw removing tool 10 has a pair of pliers type handles 14 which are pivotally connected at a point intermediate their ends by a pivot 15. The structure and design of the handles 14 is not critical to my invention, and any of the various types of pliers or similar grasping handles can be utilized.

Mounted in opposed relation on the ends of the handles 14 are a pair of screw removing heads 16. In the embodiment shown in FIG. 1, the heads 16 are formed integrally with the handles 14, although it is understood that my device might be utilized with detachable screw removing heads which attach to an ordinary set of pliers.

Figure 4:
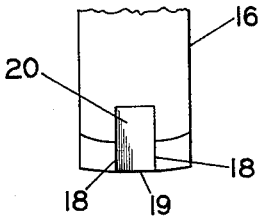
FIG. 4 is a frontal view of the screw removing head portion of the tool of FIG. 1.
Figure 3:
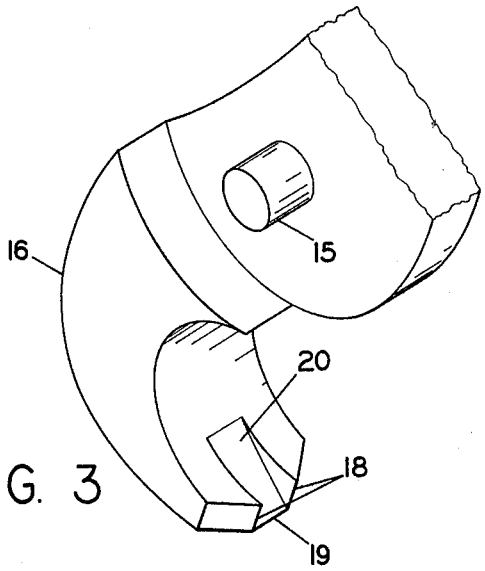
FIG. 3 is a perspective view of the screw removing head portion of the tool of FIG. 1.

The structure of the screw removing heads is best shown with respect to the perspective view of one of the heads shown in FIG. 3 and the frontal view of FIG. 4. As shown in these views, the jaw which engages the screw head is preferably U-shaped, having a pair of parallel clinching edges 18 which are disposed in laterally spaced relation. A third clinching edge 19 is disposed between the two edges 18 and is perpendicular thereto. The clinching edge 19 forms the bottom innermost edge of the screw removing head 16.

The clinching edges 18 and 19 are formed by intersections of planar surfaces cut into the hardened metal of which the screw removing heads 16 are formed. In particular, an inclined planar surface 20 preferably extends upwardly and outwardly from the cutting edge 19.

Figure 2:
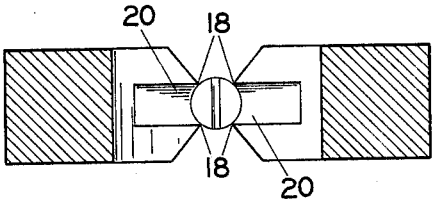
FIG. 2 is a cross sectional view thereof taken along the line 2—2 of FIG. 1.

With reference to FIG. 2, it is seen that as the opposed jaws of the two screw removing heads 16 are engaged over the head of a screw, the parallel clinching edges 18 will be forced into the sides of the screw head. At the same time, from an examination of FIGS. 1 and 2, it is seen that the third perpendicular clinching edge 19 will be forced under the screw head to oppose movement of the tool off the screw head. With the edge 19 inserted underneath the head of the screw 11, it is possible for the user to apply upward pulling force on the screw. Moreover, as he grips the handles 14 to cause the parallel clinching edges to dig into the periphery of the screw head, the screw can be turned out using its own thread by twisting the handles, since the edges 18 which have dug into the side of the screw will be able to transmit torque to the screw and will be restrained from slipping upwardly off the rounded screw head by the perpendicular clinching edge engaged against the underside of the screw head.

It is further seen that the tool portion underlying the preferred inclined planar surface 20 acts as a wedge having a sharp pointed end defined by the perpendicular clinching edge 19 which can be driven between the underside of the screw head and the underlying surface, and is of progressive thickness to apply an upward force against the underside of the screw as the screw removing heads are forced inwardly against the screw head by the application of force to the handles. Such upward force aids in the removal of the screw.

Figure 6:
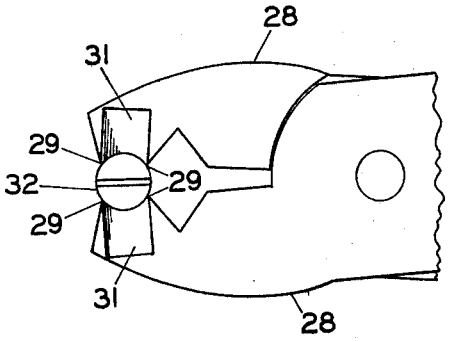
FIG. 6 is a top view of the screw removing head portion of the tool of FIG. 5 in engagement with a screw.

As is apparent from the sectional view of FIG. 2, the lateral spacing of the parallel clinching edges 18 must be less than the diameter of the screw head. Generally, I have found that a spacing between the parallel clinching edges of approximately ⅛ inch to 3/16 inch is satisfactory for most screws of common sizes, although the optimum size will depend upon the size range of the screws for which a particular tool is designed. Where the screw is substantially embedded so that it is difficult to position the perpendicular clinching edge beneath the screw head, I have found that a narrower spacing of the parallel clinching edges with respect to the size of the screw head than that illustrated in FIGS. 2 and 6, is very effective for removal of the screw. The narrower spacing permits the parallel clinching edges to firmly and effectively engage the outer periphery of the screw head even though the perpendicular clinching edges are also engaged against the same outer periphery. When so engaged, the perpendicular clinching edges also dig into the sides of the screw head to resist slipping movement of the tool off the screw head.

While the third clinching edge 19 has been shown in FIG. 3 as intersecting the pair of parallel clinching edges 18, it is apparent that the clinching edge 19 could be removed back from the edges 18, or could extend outwardly therefrom. In particular, an outwardly extending edge 19 formed as a tapered lip or wedge extending out from the bottom of the heads 16 would be adapted to cut deeply under the head of the screw and allow the screw to be pulled more easily from its hole. A construction wherein the cutting edge 19 is recessed from the parallel edges 18 can be utilized where it is desired to not dig into the surface underlying the screw head.

Figure 5:
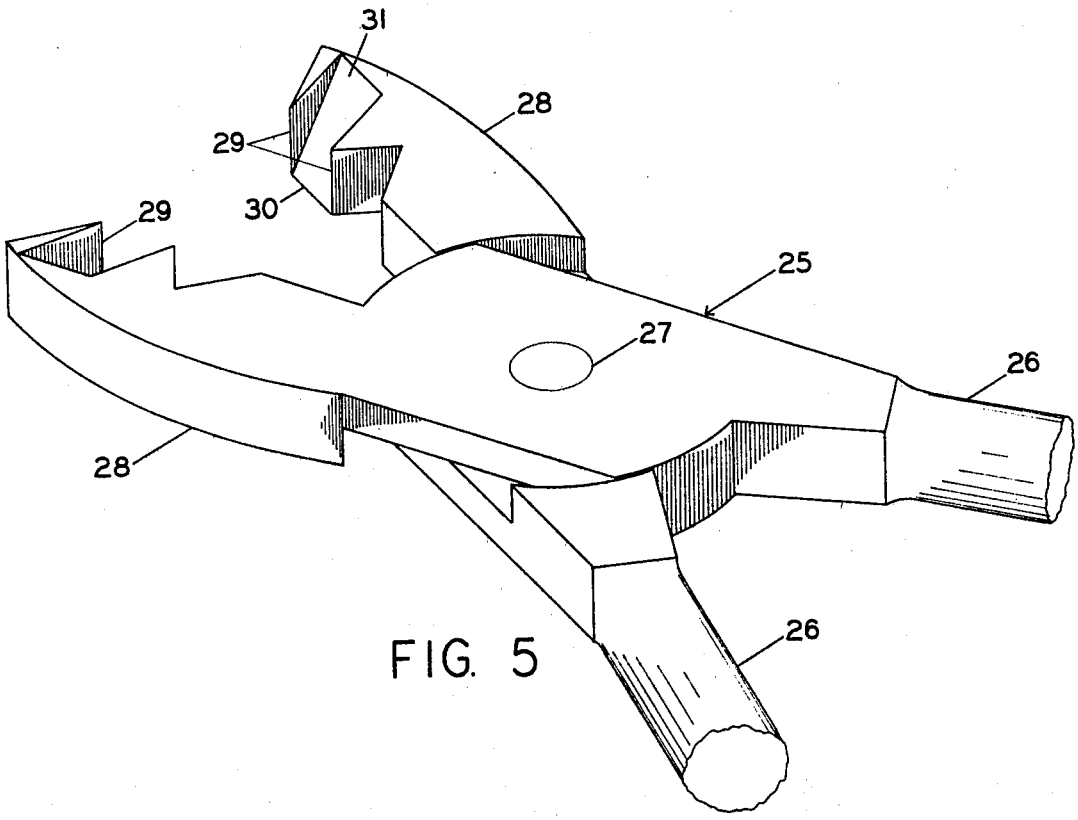
FIG. 5 is a perspective view of another embodiment of a screw removing tool in accordance with my invention.

An alternative preferred embodiment of my screw removing tool is shown generally at 25 in FIG. 5. The screw removing tool 25 also has a pair of pliers type handles 26 which are pivotally connected at a pivot 27. A pair of screw removing heads 28 are mounted on the handles 26 in opposed relation such that they may be engaged against a screw when the handles are closed toward each other by a user.

Each of the heads 28 has a pair of parallel clinching edges 29 which are disposed in spaced relation to one another and, in this embodiment, are also disposed parallel to the axis of rotation of the pivot 27, and perpendicular to the sides of the heads 28. A third clinching edge 30 is disposed between and perpendicular to the two parallel edges 29, and lies at the extreme inside edge of one side of the head 28 to form the generally U-shaped screw removing jaw shown in FIG. 5. Inclined planar surfaces 31 are also preferably utilized in this embodiment, each extending upwardly and away from the perpendicular cutting edges 30 as viewed in FIG. 5.

The use of the screw removing tool 25 is entirely analogous to that described above for the embodiment of my tool shown generally at 10, except that the heads 28 are clamped against a screw head from the side rather than from a direction perpendicular to the surface underlying the screw head. Closure of the heads 28 against a screw head 32, as shown in FIG. 6, will bring the perpendicular clinching edges 30 into engagement with the underside of the screw head, while the parallel clinching edges 29 will dig into the side of the head to allow torque to be applied thereto. The perpendicular edges 30 will prevent the parallel clinching edges from slipping movement off the screw head. The user may then turn the entire screw removing tool 25 around the screw to twist the same out of its screw hole. This embodiment of my screw removing tool allows greater torque to be applied to the screw head with less effort by the user, since the disposition of the handles 26 sideways away from the screw provides a longer lever arm through which torque may be applied by the user.

While the preferred embodiments of my invention described herein have employed a simple pivoted connection of the handles in the fashion of a common pliers, it is apparent that any other structure for mounting the screw removing heads in opposed relation whereby they may be forced together to firmly engage the screw to be removed will be the equivalent of the illustrated handles. By way of example, without limitation, the screw removing heads may be mounted in the jaw position of a levered-handle apparatus of the common "vise-grip" type, or may be mounted on handles or tool jaw elements which are connected by threaded means, such as a bolt, designed to force the heads together by the application of rotational force to the threaded means. Tools of the latter type may be preferred for the removal of large screws were it is desired to exert force on the screw by mechanical means.

It is understood that my invention is not confined to the particular construction and arrangement of parts herein illustrated and described, but embraces all such modified forms thereof as come within the scope of the following claims.

I claim:

1. A tool for removing embedded screws and the like, comprising:

a. a pair of connected handles, b. a pair of screw removal heads mounted one to each of said handles in opposed relation in position to engage a screw between said heads when said handles are forced toward a closed position, each of said screw removal heads having, 1. a pair of parallel clinching edges disposed in laterally spaced relation,
2. a third clinching edge disposed between and perpendicular to said pair of parallel clinching edges and connecting the same to form a generally U-shaped jaw, said perpendicular clinching edge forming the bottom innermost edge of each said screw removal head, whereby firm engagement of said screw removal heads with opposite sides of a screw head will force said parallel edges into the sides of the screw head to allow rotational torque to be applied to the screw to allow the same to be turned out by rotation of said handles and will cause said perpendicular edges to engage the screw head to oppose movement of the tool off the screw head.

2. The tool of claim 1 wherein each of said screw removal heads includes an inclined planar surface extending upwardly and away from said perpendicular edge of said head, whereby said inclined planar surfaces will apply force against the underside of a screw when the perpendicular edges are forced beneath the screw head and said screw removal heads are firmly engaged with the screw.

3. The tool of claim 1 wherein said heads are formed integrally with said handles.

4. The tool of claim 1 wherein the handles are pivotally connected at a point intermediate their ends and the screw removal heads are respectively mounted at adjacent ends of the handles whereby the heads will be forced toward each other to engage a screw positioned therebetween when the other ends of the handles are forced together.

5. The tool of claim 1 wherein said parallel cutting edges are spaced apart a distance of ⅛ inch to 3/16 inch.

6. A tool for removing embedded screws and the like, comprising:

a. a pair of handles pivotally connected intermediate their ends;

b. a pair of screw removal heads mounted one to each of said pair of handles in opposed relation in position to engage a screw between said heads when said handles are closed toward each other, each of said screw removal heads having, 1. a pair of parallel clinching edges disposed in spaced relation and lying parallel to the axis of rotation of said hinged handles, and
2. a third clinching edge disposed between and perpendicular to said pair of parallel clinching edges and connecting the same to form a generally U-shaped jaw, said perpendicular clinching edge lying along the inner edge of one side of each said screw removal head, whereby firm engagement of said screw removal heads with opposite sides of a screw head will force said parallel edges into the sides of the screw head to allow rotational torque to be applied to the screw to allow the same to be turned out by rotation of said handles around the screw and will cause said perpendicular edges to engage the underside of the screw head to oppose axial movement of the tool off the screw head.

7. The tool of claim 6 wherein each of said screw removal heads includes an inclined planar surface extending from said perpendicular edge of said head, whereby said inclined planar surfaces apply force against the underside of a screw as said heads are firmly engaged with the screw.

8. The tool of claim 6 wherein said heads are formed integrally with said handles.

9. The tool of claim 6 wherein the handles are pivotally connected at a point intermediate their ends and the screw removal heads are respectively mounted at adjacent ends of the handles whereby the heads will be forced toward each other to engage a screw positioned therebetween when the other ends of the handles are forced together.

10. The tool of claim 6 wherein said parallel edges are spaced apart a distance of ⅛ inch to 3/16 inch.

* * * * *